US006641405B2

(12) United States Patent
Chou

(10) Patent No.: US 6,641,405 B2
(45) Date of Patent: Nov. 4, 2003

(54) VEHICULAR POWER PLUG WITH ADJUSTABLE LENGTH

(75) Inventor: Chin-Yi Chou, Changhua (TW)

(73) Assignee: Primax Electronics, Ltd. (TW)

( * ) Notice: Subject to any disclaimer, the term of this patent is extended or adjusted under 35 U.S.C. 154(b) by 0 days.

(21) Appl. No.: 10/195,632

(22) Filed: Jul. 15, 2002

(65) Prior Publication Data

US 2003/0082930 A1 May 1, 2003

(30) Foreign Application Priority Data

Oct. 25, 2001 (TW) ..... 90126442 A

(51) Int. Cl.[7] ..... H01R 41/00
(52) U.S. Cl. ..... 439/32; 439/348; 439/668
(58) Field of Search ..... 439/32, 33, 34, 439/162, 163, 170, 347, 348, 668

(56) References Cited

U.S. PATENT DOCUMENTS 3,538,483 A * 11/1970 Dyer ..... 439/5
5,441,416 A * 8/1995 Gajewski et al. ..... 439/32
5,931,681 A * 8/1999 Thomassin et al. ..... 439/32
6,004,138 A * 12/1999 Habertson ..... 439/32
6,478,628 B1 * 11/2002 Ming ..... 439/668

* cited by examiner

*Primary Examiner*—Khiem Nguyen
(74) *Attorney, Agent, or Firm*—Madson & Metcalf

(57) ABSTRACT

A length-adjustable vehicular power plug for use with a vehicular electrical appliance is disclosed. The vehicular power plug includes a plug end electrically connected to a vehicular power source for getting a power needed for the vehicular electrical appliance; a connector end electrically connected to the vehicular electrical appliance for transmitting the power to the vehicular electrical appliance; a first sleeve body connected to the plug end for supporting the plug end; a second sleeve body connected to the connector end for supporting the connector end, and slipable relative to the first sleeve body; and a positioning member for changing the relative position between the first sleeve body and the second sleeve body from a first position to a second position in response to an external force applied on the first and second sleeve bodies, and securing the first and second sleeve bodies at the second position when the external force is removed, thereby adjusting the length of the vehicular power plug.

19 Claims, 8 Drawing Sheets

VEHICULAR POWER PLUG WITH ADJUSTABLE LENGTH

FIELD OF THE INVENTION

The present invention relates to a vehicular power plug, and more particularly to a vehicular power plug with adjustable length to meet the allocation requirements in various kinds of vehicles.

BACKGROUND OF THE INVENTION

Due to the compact size and versatility of the modern electrical appliances, many of them are developed to be suitably used in a vehicle and operatable with the vehicular direct-current power, generally 12 volts. FIG. 1 schematically shows the structure of a conventional vehicular power plug. The vehicular power plug includes a plug portion 11 to be inserted into the cigarette lighter adapter (not shown) of a vehicle, and a connector portion 12 to be connected to an electrical appliance 13. The plug portion 11 and the connector portion 12 have respectively specific configurations for different functions. The connector portion 12, for example, can be a cell phone handsfree car kit, a cell phone charger, a vehicular lamp, a fan, a speaker or a liquid crystal display. In order to be in tune with the position of the cigarette lighter adapter and meet the allocation requirements in various kinds of vehicles, the vehicular power plug is preferably length-adjustable.

Unfortunately, conventional vehicular power plugs have fixed length. If a longer power plug is required, an additional adapter will be required between the plug portion and the cigarette lighter adapter, as shown in FIG. 2A, or between the connector portion and the electrical appliance, as shown in FIG. 2B.

Please refer to FIG. 2A. The additional adapter 20 is mounted to the plug end 211 of the vehicle power plug 21, so the adapter 20 is required to have a plug end 201 with a configuration identical to that of the plug end 211 in order to be inserted into the cigarette lighter adapter in lieu of the plug end 211. The other end 202 of the adapter 20 is designed to match the plug end 211 so that the connection of the ends 211 and 202 prolongs the entire vehicle power plug 20 and 21. Further, the other end 212 of the original vehicle power plug 21 is still for connecting with the electrical appliance.

Now refer to FIG. 2B. The additional adapter 30 is mounted to the connector end 311 of the vehicle power plug 31, so the adapter 30 is required to have a connector end 301 with a configuration identical to that of the connector end 311 in order to be connected with the electrical appliance in lieu of the connector end 311. The other end 302 of the adapter 30 is designed to match the connector end 311 so that the connection of the ends 311 and 302 prolongs the entire vehicle power plug 30 and 31. Further, the other end 312 of the original vehicle power plug 21 is still for inserting into the cigarette lighter adapter.

The above-mentioned adapters 20 and 30 are designed for specifically prolonging the vehicular power plug. In other words, there is no further function associated with the complicated structure of the adapter. The use of such adapters 20 and 30 to just prolong the vehicular power plug is apparently inefficient in manufacturing time and cost. The assembling process is also bothersome.

SUMMARY OF THE INVENTION

Therefore, an object of the present invention is to provide a vehicular power plug that is extendable without any additional adapter.

Another object of the present invention is to provide a vehicular power plug with simple length-adjusting mechanism.

According to a first aspect of the present invention, a vehicular power plug with adjustable length for use with a vehicular electrical appliance includes a plug end electrically connected to a vehicular power source for getting a power needed for the vehicular electrical appliance; a connector end electrically connected to the vehicular electrical appliance for transmitting the power to the vehicular electrical appliance; a first sleeve body connected to the plug end for supporting the plug end; a second sleeve body connected to the connector end for supporting the connector end, and slipable relative to the first sleeve body; and a positioning member for changing the relative position between the first sleeve body and the second sleeve body from a first position to a second position in response to an external force applied on the first and second sleeve bodies, and securing the first and second sleeve bodies at the second position when the external force is removed, thereby adjusting the length of the vehicular power plug.

In an embodiment, the positioning member includes a resilent sustaining unit mounted on one of the first sleeve body and the second sleeve body; and a receiving unit mounted on the other one of the first sleeve body and the second sleeve body, and matching the resilent sustaining unit for engaging with the resilent sustaining unit to fix the first and second sleeve bodies at the second position.

In another embodiment, the second sleeve body sleeves around the first sleeve body, and has an inner surface faces an outer surface of the first sleeve body. Meanwhile, the positioning member includes an elastic unit passing through the first sleeve object radially; a first locking-unit attached to the elastic unit and protruding from the outer surface of the first sleeve object; and a second locking unit mounted on the inner surface of the second sleeve body and cooperating the first locking unit to lock the first locking unit in the second locking unit at the second position.

For example, the elastic unit can be a spring passing through a penetrating aperature formed on the first sleeve body in the radial direction. The first locking unit includes two balls respectively attached to two ends of the spring and partially protruding from opposite openings of the penetrating aperature. The second locking unit comprises plural pairs of holes in which each pair of the holes are arranged in opposition on the inner surface of the second sleeve body so as to form two rows of holes. The balls slip against the two rows of holes, respectively, from the first position to the second position in response to the external force, and the two rows of holes match the two balls in size so that the balls are trapped in a pair of the holes when the external force is removed to fix the first and second sleeve bodies at the second position.

Alternatively, the positioning member includes a first locking unit protrudently mounted on the outer surface of the first sleeve body; and a second locking unit mounted on the inner surface of the second sleeve body and cooperating with the first locking unit for locking the first and second sleeve bodies at the second position.

For example, the first locking unit includes a resilent piece with one end fixed on the outer surface of the first sleeve body and the other end as a protrudent free end. The second locking unit includes a series of notches arranged axially on the inner surface of the second sleeve body. The notches matches the protrudent free end for locking the protrudent free end therein.

For another example, the first locking unit includes a resilent arc slice mounted on the outer surface of the first sleeve body, and the second locking unit includes a trench mounted on the inner surface of the second sleeve body. The resilent arc slice slides in the trench in response to the external force.

In a further embodiment, the positioning member includes a first locking unit protrudently mounted on the inner surface of the second sleeve body; and a second locking unit mounted on the outer surface of the first sleeve body and cooperating with the first locking unit for locking the first and second sleeve bodies at the second position.

According to a second aspect of the present invention, a vehicular power plug with adjustable length for use with a vehicular electrical appliance includes a plug end electrically connected to a vehicular power source for getting a power needed for the vehicular electrical appliance; a connector end electrically connected to the vehicular electrical appliance for transmitting the power to the vehicular electrical appliance; a first body connected to the plug end for supporting the plug end; a second body connected to the connector end for supporting the connector end; and a positioning member connected to the first and second bodies for changing an overlapping area of the first body and the second body in response to an external force to adjust the length of the vehicular power plug.

Preferably, the first body and the second body are respectively first cylindrical sleeve and second cylindrical sleeve arranged telescopically.

Preferably, the positioning member includes a resilent sustaining unit mounted on one of the first cylindrical sleeve and the second cylindrical sleeve; and a receiving unit mounted on the other one of the first cylindrical sleeve and the second cylindrical sleeve and matching the resilent element for fixing the first and second cylindrical sleeves at a specific relative position according to the overlapping area.

According to a third aspect of the present invention, a vehicular power plug with adjustable length for use with a vehicular electrical appliance includes a plug end electrically connected to a vehicular power source for getting a power needed for the vehicular electrical appliance; a connector end electrically connected to the vehicular electrical appliance for transmitting the power to the vehicular electrical appliance; a first sleeve body connected to the plug end for supporting the plug end; a second sleeve body connected to the connector end for supporting the connector end, and telescopically moved relative to the first sleeve body; a resilent unit mounted on the first sleeve body; and a receiving unit mounted on the second sleeve body and matching the resilent element, in which a relative position between the first sleeve body and the second sleeve body is changed in response an external force applied on the sleeve bodies, and the relative position is fixed by locking the resilent unit in the receiving unit when the external force is removed.

BRIEF DESCRIPTION OF THE DRAWINGS

The present invention may best be understood through the following description with reference to the accompanying drawings, in which.

DETAILED DESCRIPTION OF THE PREFERRED EMBODIMENT

The present invention will now be described more specifically with reference to the following embodiments. It is to be noted that the following description of the preferred embodiment of this invention is presented herein for purpose of illustration and description only; it is not intended to be exhaustive or to be limited to the precise form disclosed.

Figure 1:
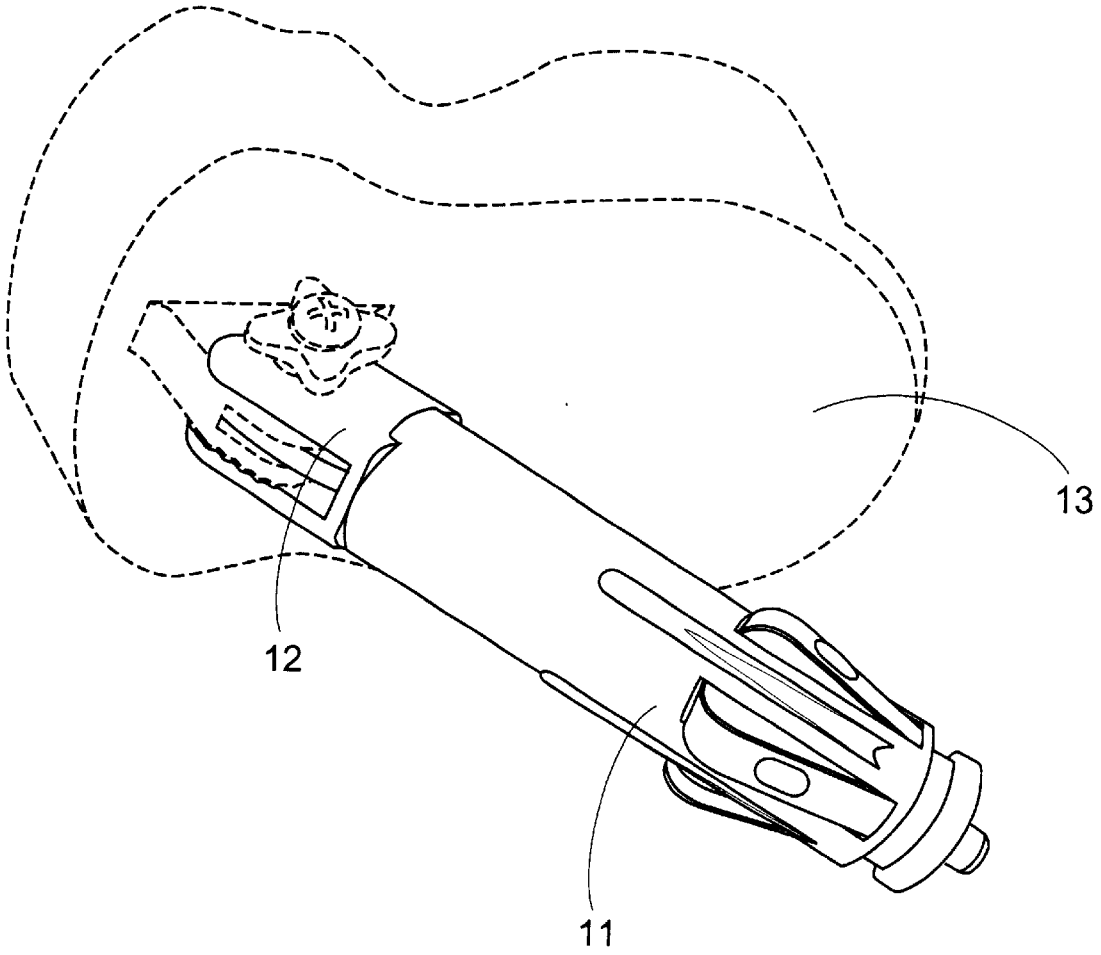
Fig.1 PRIOR ART
FIG. 1 is a shematic diagram showing the structure of a conventional vehicular DC-power plug.
Figure 2A:
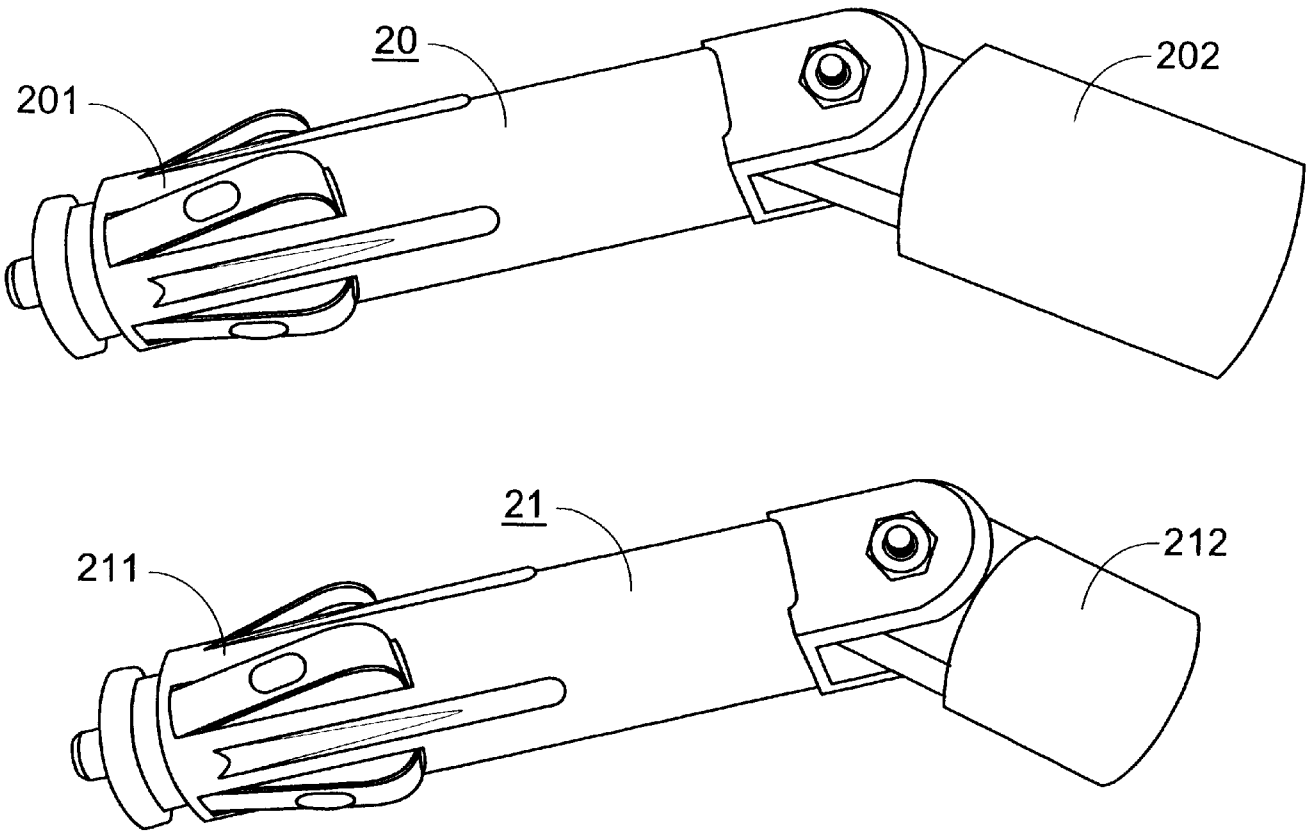
Fig.2A PRIOR ART
FIG. 2A is a schematic diagram showing an additional adapter required between the plug portion of the power plug of FIG. 1 and a cigarette lighter adapter for extending the power plug.
Figure 2B:
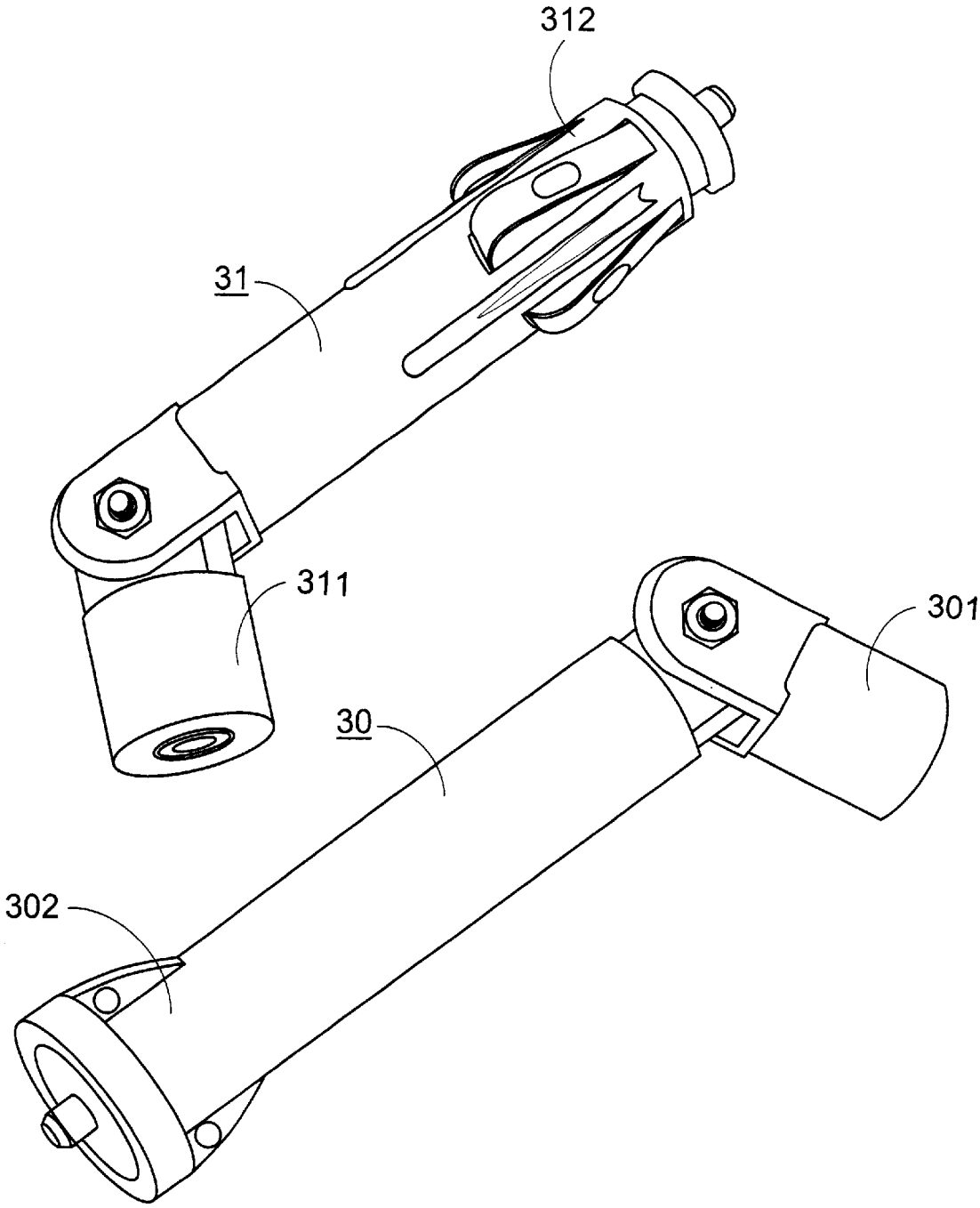
Fig.2B PRIOR ART
FIG. 2B is a schematic diagram showing an additional adapter required between the connector portion of the power plug of FIG. 1 and the electrical appliance for extending the power plug.
Figure 3:
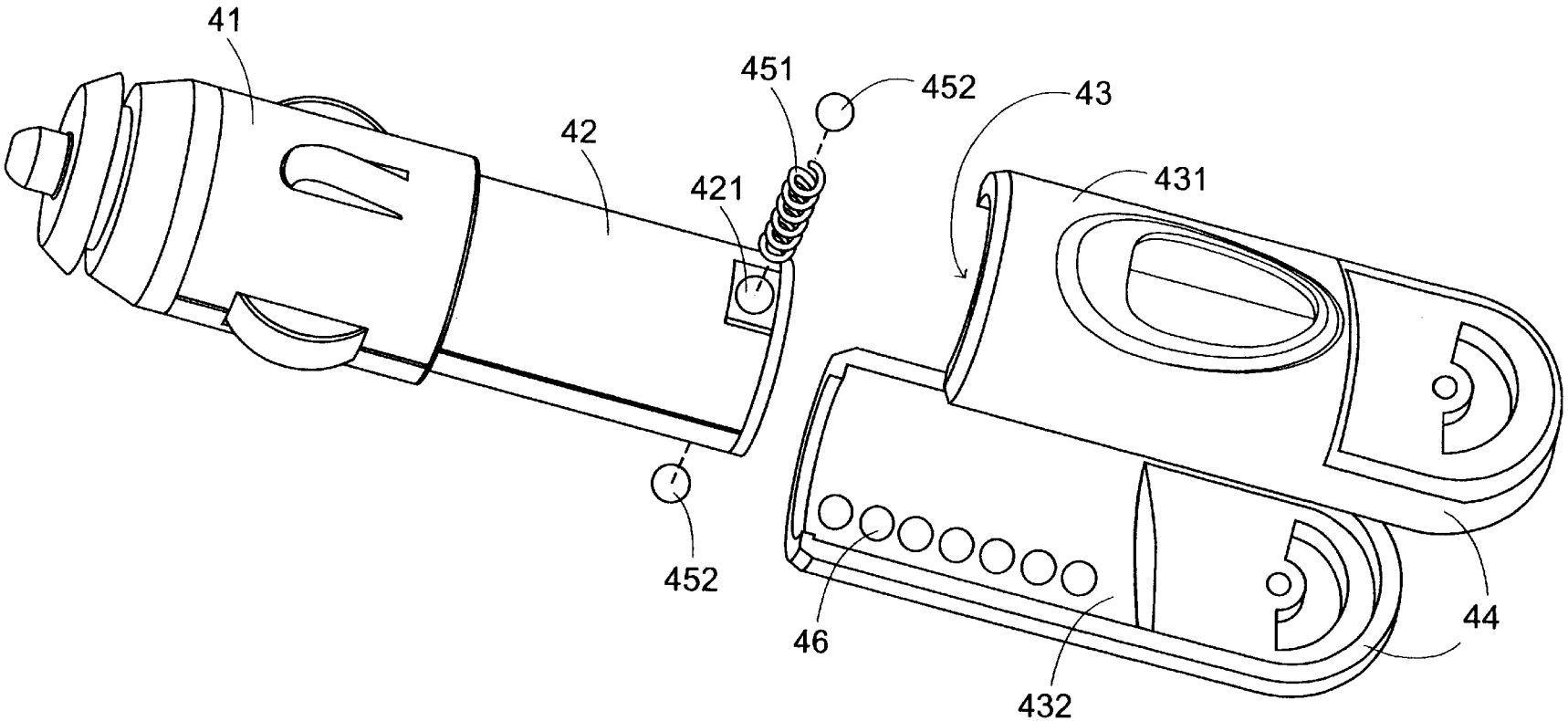
FIG. 3 is a resolving diagram schematically showing a first preferred embodiment of a length-adjustable vehicular power plug according to the present invention.
Figure 4A:
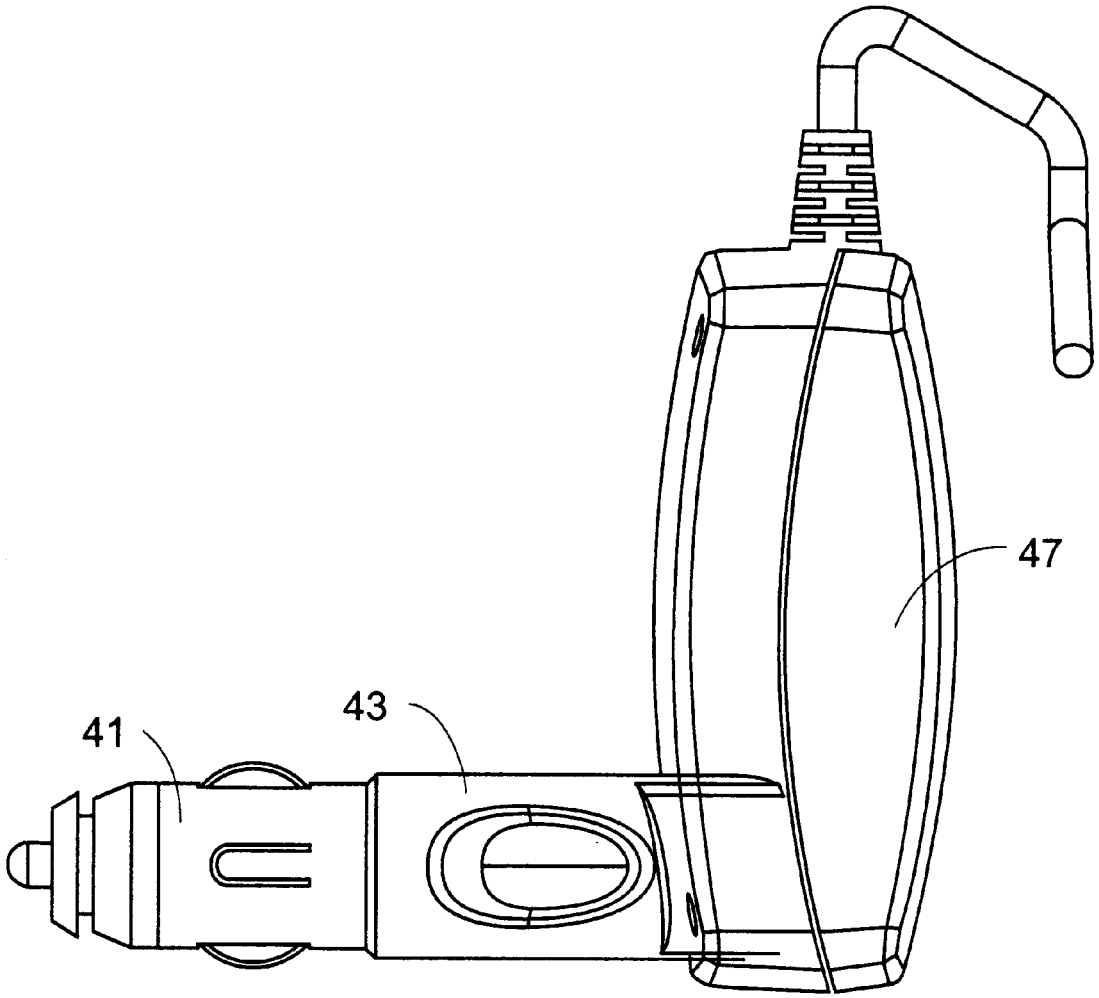
FIG. 4A schematically shows the vehiclular power plug of FIG. 3 in a retracted condition.
Figure 4B:
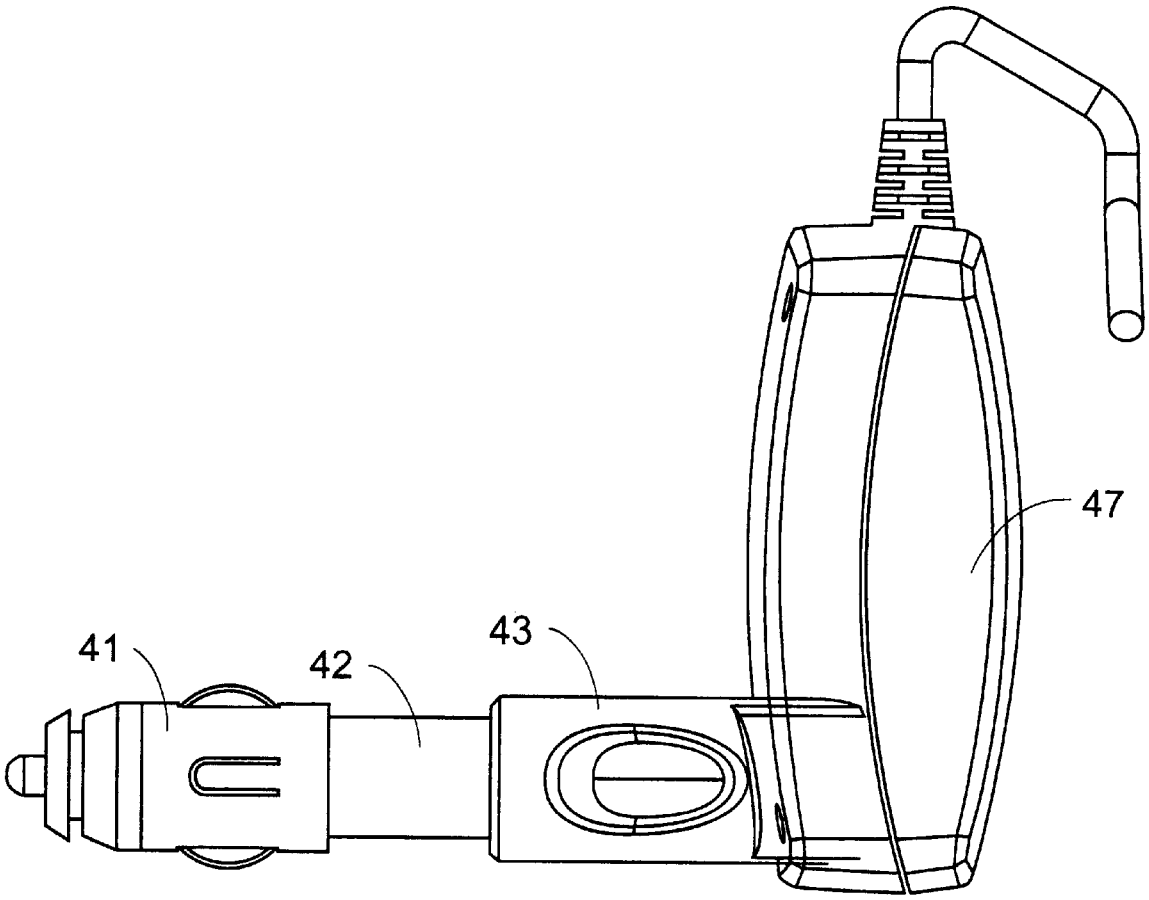
FIG. 4B schematically shows the vehiclular power plug of FIG. 3 in an extended condition.

Please refer to FIG. 3 which is a resolving diagram schematically showing a first preferred embodiment of a length-adjustable vehicular power plug according to the present invention. The vehicular power plug includes a plug end 41, a cylindrical sleeve 42, another cylindrical sleeve 43 and a connector end 44. The plug end 41 is to be inserted into the cigarette lighter (not shown), and the connector end 44 is to be connected to an electrical appliance (not shown). The cylindrical sleeve 42 connected to the plug end 41 has an outer diameter smaller than the inner diameter of the cylindrical sleeve 43 connected to the connector end 44, and the cylindrical sleeve 43 telescopically sleeves around the cylindrical sleeve 42. On the cylindrical sleeve 42, a pentrating aperture 421 is provided radially. A compression spring 451 is disposed inside the penetrating aperture 421, and two balls 452 are attached to both ends of the compression spring 451, and slightly protrude from the opposite openings of the aperture 421, respectively. Two component pieces 431 and 432 of the cylindrical sleeve 43 cover the cylindrical sleeve 42 from the opposite sides, and the two balls 452 sustain against the inner surface of the cylindrical sleeve 43 after the power plug is assembled. Further, two rows of holes 46 are arranged axially and oppositely on the inner surface of the cylindrical sleeve 43. Two holes 46 are provided in pair, and have size matching the balls 452 so that the balls can be trapped in one of the pairs of holes to keep the cylindrical sleeves at a specific relative position. The assembled power plug is shown in FIGS. 4A or 4B, and it can transmit power from a cigerette lighter to a vehicular electrical appliance such as a cell phone handsfree car kit 47.

When an external force is exerted on the vehicular power plug, the cylindrical sleeve 42 will telescopically move relative to the cylindrical sleeve 43. Therefore, the balls 452 escape from the originally coupled holes 46, The presence of the compression spring 451 allows the balls 452 to be retracted into the penetrating aperture 421 a little bit under the pressure of the inner wall of the cylindrical sleeve 43 so as to be able to pass by other pairs of holes 46. Afterwards, the external force is removed to have the balls 452 trapped in a selected pair of holes 46 to disallow the further relative movement of the two cylindrical sleeves 42 and 43 when a desired plug length has been obtained. Of course, the length of the power plug can be further adjusted by exerting thereon and then removing therefrom another external force. While FIG. 4A schematically shows the vehiclular power plug in a retracted condition, FIG. 4B schematically shows the vehiclular power plug in an extended condition.

Figure 5:
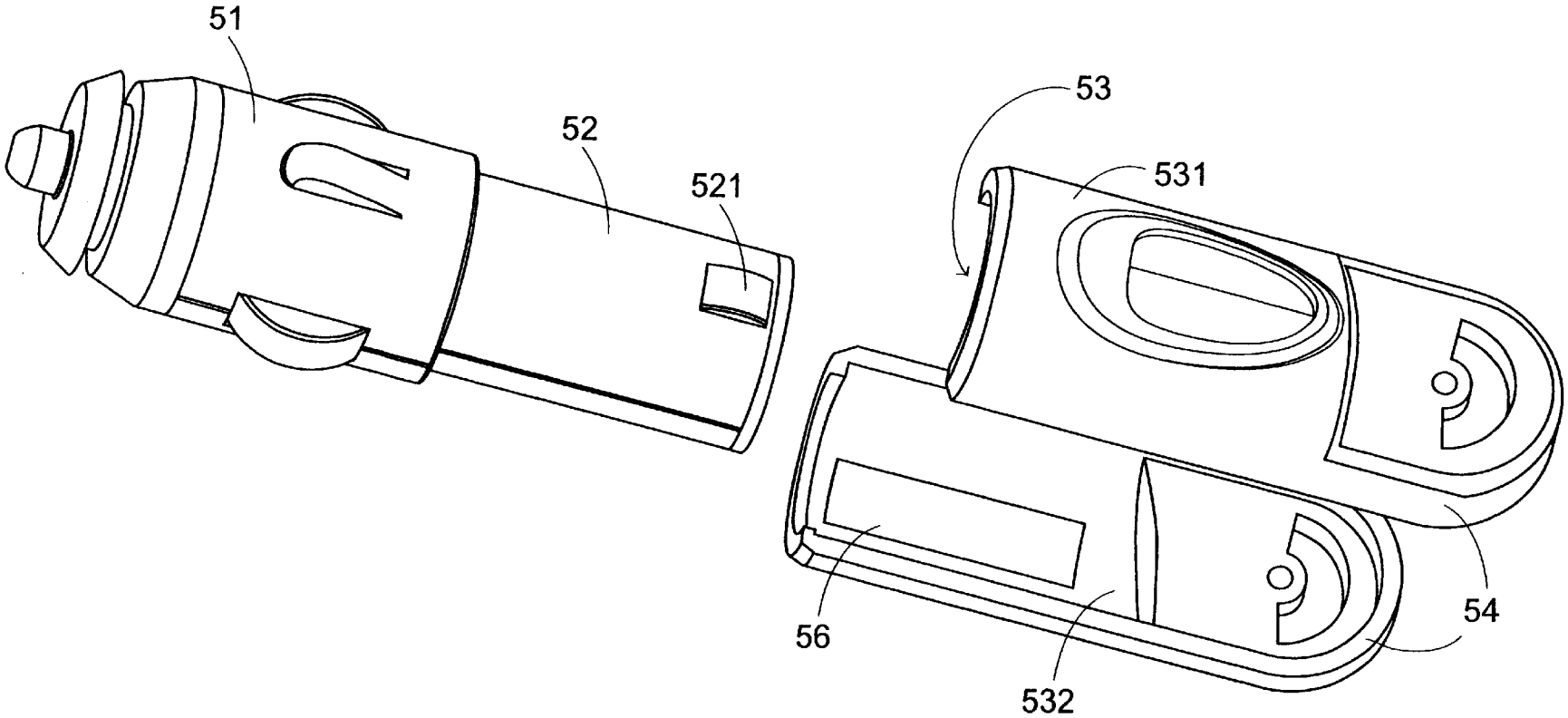
FIG. 5 is a second preferred embodiment of a length-adjustable vehicular power plug according to the present invention.

Please refer to FIG. 5 which is a second preferred embodiment of a length-adjustable vehicular power plug according to the present invention. The vehicular power plug includes a plug end 51, a cylindrical sleeve 52, another cylindrical sleeve 53 and a connector end 54. Like the embodiment described above, the cylindrical sleeve 52 connected to the plug end 51 has an outer diameter smaller than the inner diameter of the cylindrical sleeve 53 connected to the connector end 54, and the two component pieces 531 and 532 of the cylindrical sleeve 53 secure to each other with the cylindrical sleeve 52 wrapped inside. the cylindrical sleeve 53 telescopically sleeves around the cylindrical sleeve 52 to adjust the overall length of the vehicular power plug.

In this embodiment, two resilient arc slices 521 are secured onto the outer surface of the cylindrical sleeve 52 oppositely. Further, two trenches 56 are provided on the inner surface of the cylindrical sleeve 53 in positions and sizes corresponding to the two resilient arc slices 521. When an external force is exerted on the vehicular power plug, the cylindrical sleeve 52 will telescopically move relative to the cylindrical sleeve 53. Meanwhile, the resilient arc slices 521 slides in the trenches 56, respectively, until a desired length is achieved. Then remove the external force to have the resilient arc slices 521 sustain against the trenches 56 to fix the relative position of the two cylindrical sleeves 52 and 53. In this embodiment, the length adjustment is continuous. In other words, there is no obvious stage for length selection. In addition, the treches 56 are not necessary for the movement of the resilient arc slices against the inner wall, but it is advantageous to guide and position the resilient arc slices. It is to be noted that the position arrangement of the resilient arc slices and the trenches can also be exchanged without effecting the operation of the power plug. That is, the resilient arc slices can be arranged on the inner surface of the cylindrical sleeve 53, and the treches can be arranged on the outer surface of the cylindrical sleeve 52.

Figure 6:
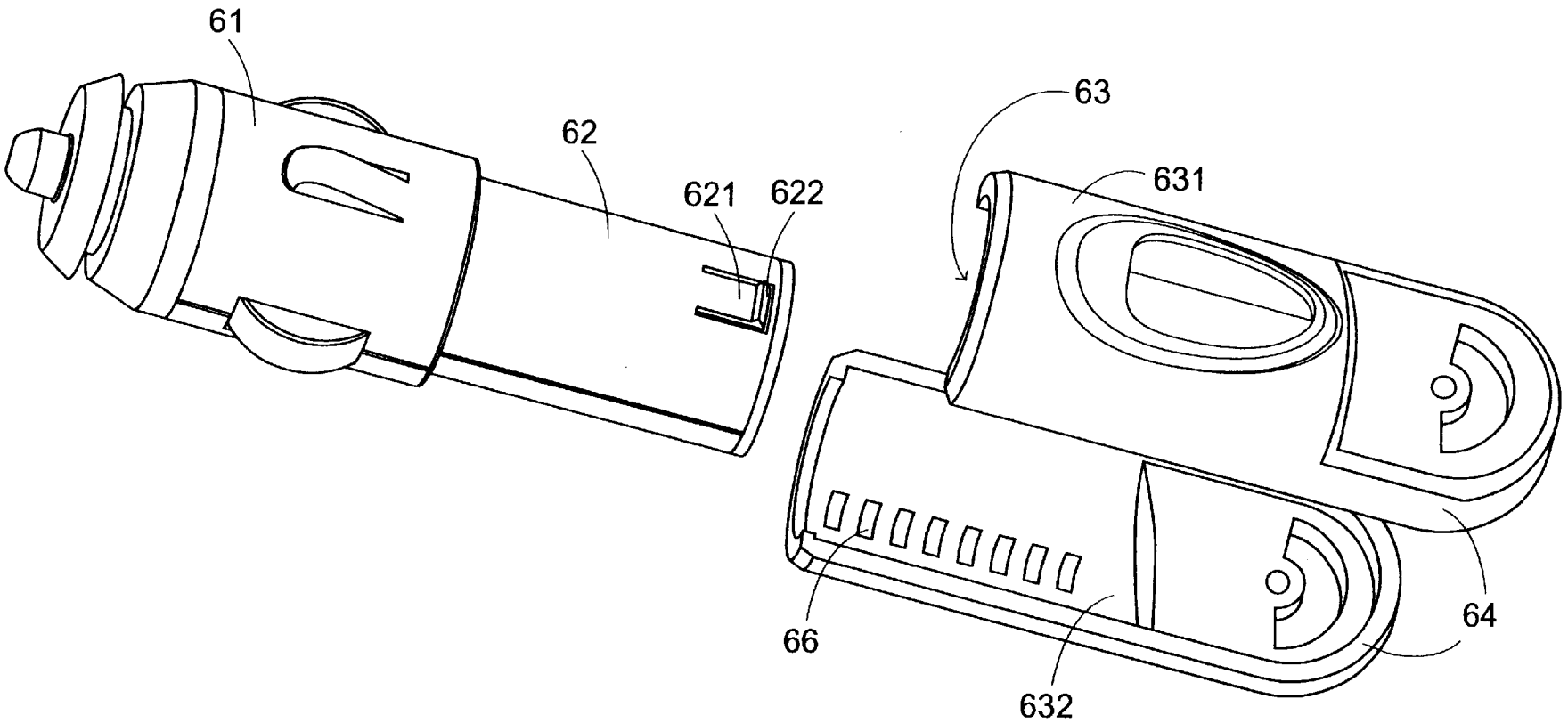
FIG. 6 is a third preferred embodiment of a length-adjustable vehicular power plug according to the present invention.

Please refer to FIG. 6 which is a third preferred embodiment of a length-adjustable vehicular power plug according to the present invention. The vehicular power plug is similar to that shown in FIG. 5, and includes a plug end 61, a cylindrical sleeve 62, another cylindrical sleeve 63 consisted of two component pieces 631 and 632, and a connector end 64. The positioning member of this embodiment, however, includes two resilient pieces 621 arranged on the outer surface of the cylindrical sleeve 62, and two corresponding series of notches 66 arranged on the inner surface of the cylindrical sleeve 62. The resilient pieces 621 have respective protrudent free ends 622. When the vehicular power plug is assembled, the resilient pieces 621 engage with a pair of notches 66 by their respective free ends 622. The engagement relationship is altered by exerting an external force on one of the two cylindrical sleeves 62 and 63 to move the cylindrical sleeve 62 relative to the cylindrical sleeve 63. Meanwhile, the free ends 622 will escape from the notches and pass by other pairs of notches in response to the external force. When a desired length of the entire power plug is achieved, remove the external force and have the free ends 622 enter a selected pair of notches for engagement, thereby fixing the relative position of the two cylindrical sleeves so as to keep the length of the plug.

It is understood that in spite two sets of positioning members are illustrated in the embodiments, only one or more than two positioning members can also work for length adjustment according to the present invention. Further, the diameter of the cylindrical sleeve connected to the plug end is not necessarily larger than the diameter of the cylindrical sleeve connected to the connector end. The cylindrical sleeve connected to the plug end can also telescopically sleeve around the cylindrical sleeve connected to the connector end.

According to the present invention, no additional adapter is required for extending the power plug, so the material and assembling costs are minimized. Moreover, the length adjust mechanism is quite easy, reliable and flexible, so it is efficient in operation.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A vehicular power plug with adjustable length for use with a vehicular electrical appliance, comprising:

a plug end electrically connected to a vehicular power source for getting a power needed for said vehicular electrical appliance;

a connector end electrically connected to said vehicular electrical appliance for transmitting said power to said vehicular electrical appliance;

a first sleeve body connected to said plug end for supporting said plug end;

a second sleeve body connected to said connector end for supporting said connector end, and slipable relative to said first sleeve body; and a positioning member for changing the relative position between said first sleeve body and said second sleeve body from a first position to a second position in response to an external force applied on said first and second sleeve bodies, and securing said first and second sleeve bodies at said second position when said external force is removed, thereby adjusting the length of said vehicular power plug.

2. The vehicular power plug according to claim 1 wherein said positioning member comprises:

a resilent sustaining unit mounted on one of said first sleeve body and said second sleeve body; and a receiving unit mounted on the other one of said first sleeve body and said second sleeve body, and matching said resilent sustaining unit for engaging with said resilent sustaining unit to fix said first and second sleeve bodies at said second position.

3. The vehicular power plug according to claim 1 wherein said second sleeve body sleeves around said first sleeve body, and has an inner surface faces an outer surface of said first sleeve body.

4. The vehicular power plug according to claim 3 wherein said positioning member further comprises:

an elastic unit passing through said first sleeve object radially;

a first locking unit attached to said elastic unit and protruding from said outer surface of said first sleeve object; and a second locking unit mounted on said inner surface of said second sleeve body and cooperating said first locking unit to lock said first locking unit in said second locking unit at said second position.

5. The vehicular power plug according to claim 4 wherein said elastic unit is a spring passing through a penetrating aperature formed on said first sleeve body in the radial direction.

6. The vehicular power plug according to claim 5 wherein said first locking unit comprises two balls respectively attached to two ends of said spring and partially protruding from opposite openings of said penetrating aperature, said second locking unit comprises plural pairs of holes in which each pair of said holes are arranged in opposition on said inner surface of said second sleeve body so as to form two rows of holes, said balls slip against said two rows of holes, respectively, from said first position to said second position in response to said external force, and said two rows of holes match said two balls in size so that said balls are trapped in a pair of said holes when said external force is removed to fix said first and second sleeve bodies at said second position.

7. The vehicular power plug according to claim 3 wherein said positioning member further comprises:

a first locking unit protrudently mounted on said outer surface of said first sleeve body; and a second locking unit mouted on said inner surface of said second sleeve body and cooperating with said first locking unit for locking said first and second sleeve bodies at said second position.

8. The vehicular power plug according to claim 7 wherein said first locking unit comprises a resilent piece with one end fixed on said outer surface of said first sleeve body and the other end as a protrudent free end, said second locking unit comprises a series of notches arranged axially on said inner surface of said second sleeve body, and said notches matches said protrudent free end for locking said protrudent free end therein.

9. The vehicular plug according to claim 7 wherein said first locking unit comprises a resilent arc slice mounted on said outer surface of said first sleeve body, said second locking unit comprises a trench mounted on said inner surface of said second sleeve body, and said resilent arc slice slides in said trench in response to said external force.

10. The vehicular power plug according to claim 3 wherein said positioning member further comprises:

a first locking unit protrudently mounted on said inner surface of said second sleeve body; and a second locking unit mouted on said outer surface of said first sleeve body and cooperating with said first locking unit for locking said first and second sleeve bodies at said second position.

11. A vehicular power plug with adjustable length for use with a vehicular electrical appliance, comprising:

a plug end electrically connected to a vehicular power source for getting a power needed for said vehicular electrical appliance;

a connector end electrically connected to said vehicular electrical appliance for transmitting said power to said vehicular electrical appliance;

a first body connected to said plug end for supporting said plug end;

a second body connected to said connector end for supporting said connector end; and a positioning member connected to said first and second bodies for changing an overlapping area of said first body and said second body in response to an external force to adjust the length of said vehicular power plug.

12. The vehicular power plug according to claim 11 wherein said first body and said second body are respectively first cylindrical sleeve and second cylindrical sleeve arranged telescopically.

13. The vehicular power plug according to claim 12 wherein said positioning member further comprises:

a resilent sustaining unit mounted on one of said first cylindrical sleeve and said second cylindrical sleeve; and a receving unit mounted on the other one of said first cylindrical sleeve and said second cylindrical sleeve and matching said resilent element for fixing said first and second cylindrical sleeves at a specific relative position according to said overlapping area.

14. The vehicular power plug according to claim 13 wherein said resilent sustaining unit is a resilent piece with a protrudent free end, said receiving unit comprises a series of notches arranged axially, and said protrudent free end of said resilent piece moves among said series of notches in response to said external force.

15. The vehicular power plug according to claim 13 wherein said resilent sustaining unit comprises a resilent arc slice, said receiving unit comprises a trench, and said resilent arc slice slides in said trench in response to said external force.

16. The vehicular power plug according to claim 12 wherein an inner diameter of said second cylindrical sleeve is larger than an outer diameter of said first cylindrical sleeve so that an inner surface of said second cylindrical sleeve faces to an outer surface of said first cylindrical sleeve.

17. The vehicular power plug according to claim 16 wherein said positioning member further comprises:

an elastic unit passing through said first cylindrical sleeve radially;

a first locking unit attached to ends of said elastic unit and protruding from said outer surface of said first cylindrical sleeve; and a second locking unit mounted on said inner surface of said second cylindrical sleeve and engaging with said first locking unit for fixing said first and second cylindrical sleeves at a specific relative position according to said overlapping area.

18. The vehicular power plug according to claim 17 wherein said elastic unit is a spring passing through a penetrating aperature formed on said first cylindrical sleeve in a radial direction, said first locking unit comprises two balls respectively attached to two ends of said spring and partially protruding from openings of said penetrating aperature, and said second locking unit comprises two rows of holes arranged in pair on said inner surface of said second cylindrical sleeve.

19. A vehicular power plug with adjustable length for use with a vehicular electrical appliance, comprising:

a plug end electrically connected to a vehicular power source for getting a power needed for said vehicular electrical appliance;

a connector end electrically connected to said vehicular electrical appliance for transmitting said power to said vehicular electrical appliance;

a first sleeve body connected to said plug end for supporting said plug end;

a second sleeve body connected to said connector end for supporting said connector end, and telescopically moved relative to said first sleeve body;

a resilent unit mounted on said first sleeve body; and a receiving unit mounted on said second sleeve body and matching said resilent element, in which:

a relative position between said first sleeve body and said second sleeve body is changed in response an external force applied on said sleeve bodies, and said relative position is fixed by locking said resilent unit in said receiving unit when said external force is removed.

* * * * *